United States Patent [19]

Inaba

[11] Patent Number: 4,873,553

[45] Date of Patent: Oct. 10, 1989

[54] VARIABLE PRESSURE CONTROLS OF FIXING DEVICE IN ELECTROPHOTOGRAPHIC COPYING MACHINE

[75] Inventor: Masakatsu Inaba, Nara, Japan

[73] Assignee: Sharp Kabushiki Kaisha, Osaka, Japan

[21] Appl. No.: 225,627

[22] Filed: Jul. 27, 1988

Related U.S. Application Data

[63] Continuation of Ser. No. 107,848, Oct. 6, 1987, abandoned, which is a continuation of Ser. No. 869,328, Jun. 2, 1986, abandoned.

[30] Foreign Application Priority Data

Jun. 14, 1985 [JP] Japan ..... 60-130509

[51] Int. Cl.[4] ..... G03G 15/20

[52] U.S. Cl. ..... 355/295; 355/282; 219/216; 219/496

[58] Field of Search ..... 355/3 FU, 14 FU, 282, 355/295; 219/216, 469, 496; 427/13, 14.1, 25, 26, 428; 118/661

[56] References Cited

U.S. PATENT DOCUMENTS 4,473,290 9/1984 Iwao ..... 355/3 FU

*Primary Examiner*—A. C. Prescott

*Attorney, Agent, or Firm*—Flehr, Hohbach, Test, Albritton & Herbert

[57] ABSTRACT

A variable pressure control of fixing device, which includes a fixing roller and a compression roller in contact with each other and serves to fix a toner image on a transfer sheet by passing this sheet between these rollers, comprises a coil spring having one end connected to the fixing roller so as to compress it against the comprssion roller, a rod connected to the other end of the coil spring, and solenoids for moving the rod.

5 Claims, 2 Drawing Sheets

Figure 1:
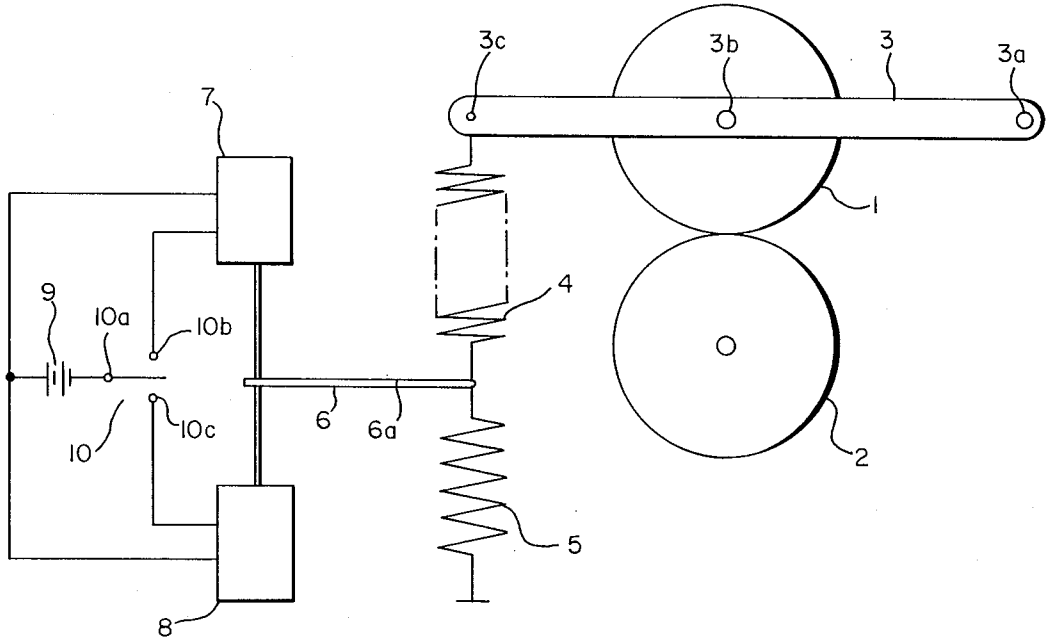

VARIABLE PRESSURE CONTROLS OF FIXING DEVICE IN ELECTROPHOTOGRAPHIC COPYING MACHINE

This is a continuation of application Ser. No. 107,848 filed Oct. 6, 1987, now abandoned, which is a continuation of application Ser. No. 869,328 filed June 2, 1986, now abandoned.

This invention relates to a fixing device for an electrophotographic copying machine and more particularly to a fixing device which operates adjustably in accordance with the thickness of the paper being used.

The fixing device for an ordinary electrophotographic copying machine comprises a fixing roller which is heated to an elevated temperature and a compression roller which is compressed against this fixing roller such that a transfer paper carrying a toner image will pass between these rollers. The toner image, which is transfered as the transfer paper passes through, is dissolved by heat and fixed on a sheet of copy paper by the compressive force between the fixing roller and the compression roller.

Recently, however, copying machines are required to serve more functions than before and they are used for a greater variety of purposes. Accordingly, modern copying machines must be able to handle thin tracing paper as well as thick paper, like postcards, for transferring and fixing toner images.

For each type of paper which is passed between the fixing roller and the compression roller, there is an optimum value of pressure to be applied between them. In general, the pressure between the fixing roller and the compression roller (hereinafter referred to as the fixing pressure) should be large if the paper is thick, while better results are obtained with a reduced fixing pressure if the paper is thin.

In a conventional fixing device, however, the fixing pressure is maintained at a constant value of about 20 kg-weight which is considered best suited for ordinary transfer paper of surface density about 60–80 g/cm$^2$. When a thin sheet of transfer paper is fixed, therefore, the applied pressure is too great and this tends to wrinkle and/or curl the paper, or to lower the quality of the image by crushing the toner image with an excessive force. When a thick sheet of paper is fixed, by contrast, the pressure is not sufficiently large and this tends to cause insufficient fixing.

In view of the above, it is an object of the present invention to provide a fixing device for an electrophotographic copying machine or the like which can adjust the fixing pressure according to the thickness of the sheet being used.

The above and other objects of the present invention are achieved by providing a fixing device which comprises an elastic means such as a coil spring with one end connected to the fixing roller and adapted to apply a biasing force to the fixing roller in the direction of the compression roller, an arm for connecting the other end of this coil spring, and solenoids which serve to move this arm up and down. Thus, the elastic force of the coil spring, which provides the fixing pressure by biasing the fixing roller in the direction of the compression roller, can be adjusted by moving up or down the arm connected to the fixing roller by the operation of the solenoids according to the thickness of the paper which is being passed through.

Figure 2B:
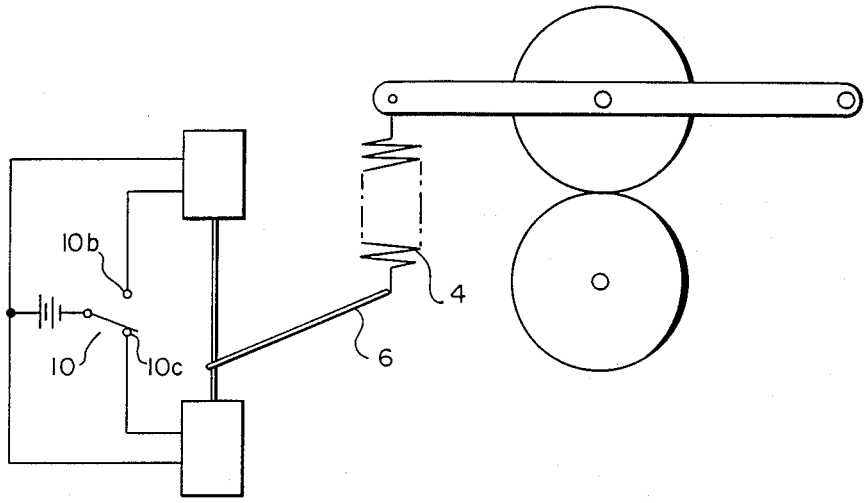
Figure 2A:
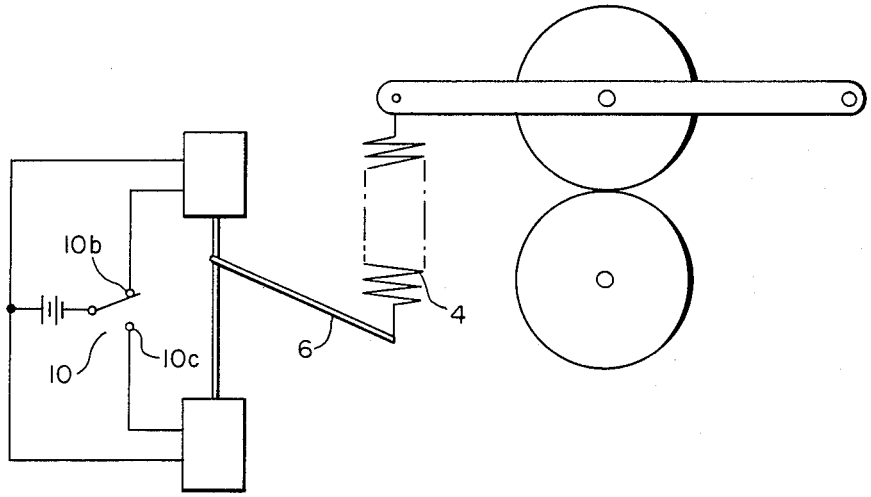

The accompanying drawings, which are incorporated in and form a part of the specification, illustrate an embodiment of the present invention and, together with a description, serve to explain the principles of the invention. In the drawings:

FIG. 1 is a diagram showing the structure of a variable pressure control of a fixing device embodying the present invention, and FIGS. 2A and 2B are diagrams showing the control of FIG. 1 when the fixing pressure is increased and decreased, respectively.

In FIG. 1, there is shown the structure of a variable pressure control of a fixing device according to an embodiment of the present invention. A fixing roller 1 is in contact with a compression roller 2 and is rotatably attached to a bearing **3*b* nearly at the center of a biasing arm 3 which is rotatably supported around an axis 3*a* at the right-hand end by the main frame (not shown) of the fixing device. One end of a coil spring 4 for biasing is engaged to the left-hand end 3*c* of the arm 3. The coil spring 4 is stretched between the arm 3 and a rod 6 so as to apply its compressive force on the biasing arm 3 in the downward direction such that the fixing roller 1 is compressed in the direction of the compression roller 2. The other end of the coil spring 4 is attached to the right-hand end of the rod 6, but there is provided another coil spring 5 for balancing the force of the first coil spring 4. One end of the second coil spring 5 is attached to the right-hand end of the rod 6. The balancing coil spring 5 is stretched in the direction opposite to the biasing coil spring 4 such that the elastic forces of the two coil springs 4 and 5 are balanced in the absence of external forces on the rod 6 and that the rod 6 assumes a horizontal position in such a case. In this balanced situation, the compressive force between the fixing roller 1 and the compression roller 2** is about 20 kg.

The rod 6 is supported rotatably around a horizontal axis **6*a* which penetrates it at a point somewhat to the right of its center. The left-hand end of the rod 6 is connected to the moveable pieces of solenoids 7 and 8. Each solenoid 7 or 8 is adapted to push out its moveable piece when a current is passed therethrough. One of the electrodes of each solenoid 7 or 8 is connected to the positive terminal of a battery 9 and the other electrodes of the solenoids 7 and 8 are connected to a junction 10*b* or 10*c* of a switch 10 having a neutral position. The common junction 10*a* of the switch 10 is connected to the negative terminal of the battery 9. Thus, the rod 6 is maintained at the horizontal position when the switch 10 is in the neutral position because neither solenoid 7 or 8 exerts a force on its moveable piece. When the switch 10 is connected to the junction 10*b* or 10*c*, either one of the solenoids 7 or 8 is activated and the rod 6 rotates to the left or to the right. The switch 10 may be attached on the surface of the copier housing so that the user can easily operate it. Alternatively, a control unit may be provided to operate the switch 10** with a membrane switch provided on an operator's panel for imputting a switch signal to the control unit. Still another alternative may be to provide a sensor for detecting the thickness of transfer paper such that a control unit controls the switch automatically on the basis of the output from the sensor.

FIGS. 2A and 2B show situations where the solenoids 7 and 8 have been operated. FIG. 2A shows the situation where the switch 10 is switched to the junction **10*b* such that the solenoid 7 pulls up the left-hand end of the rod 6, causing it to rotate in the clockwise direction around the horizontal axis 6***a*. The right-hand end of the rod 6 is thereby moved in the downward direction and the coil spring 4 is elongated, increasing the compressive force of the fixing roller 1 against the compression roller 2. If adjustments are made such that the compressive force in this situation is about 25 kg, the rollers 1 and 2 provide an optimum fixing pressure for fixing a thick sheet of paper.

FIG. 2B, on the other hand, shows the situation where the switch 10 is switched to the junction 10*c* such that the solenoid 8 pulls down the left-hand end of the rod 6, causing it to rotate in the counter-clockwise direction around the horizontal axis 6*a*. The right-hand end of the rod 6 is thereby moved in the upward direction and the coil spring 4 is shortened, weakening the compressive force between the fixing roller 1 and the compression roller 2. If adjustments are further made such that the compressive force in the situation of FIG. 2B is about 15 kg, the rollers 1 and 2 provide an optimum fixing pressure for fixing a thin sheet of paper.

In summary, an optimum fixing pressure can be applied between the fixing roller and the compressive roller according to the thickness of the paper which passes between them if use is made of a fixing device with a variable pressure control according to the present invention. This allows toner images to be fixed under optimum conditions and prevents thin sheets of paper from becoming wrinkled or curled up. Insufficient fixing can similarly be avoided when a thick sheet of paper is used. Not only is the quality of copied images improved but a loss in time and transfer paper an also be minimized with a control embodying the present invention. In short, fixing devices of this invention can better serve the modern copiers which are required to be able to handle all types of paper.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the coil springs may be replaced by any suitably elastic means. The figures are intended to be schematic and not to represent preferred shapes or dimensional relationships among various components. Modifications and variations which may be apparent to a person skilled in the art are included within the scope of this invention.

What is claimed is:

1. A variable pressure control of a fixing device having a fixing roller and a compression roller in contact with each other and serving to fix a toner image on a transfer sheet by passing said sheet between said rollers, said control comprising:

an elastic means having one end operationally connected to said fixing roller so as to compress said fixing roller against said compression roller, adjusting means for adjusting the elastic force of said elastic means such that said rollers press each other selectably at an increased pressure level or at a reduced pressure level, and switching means for automatically controlling said adjusting means to select between said increased and reduced pressure levels according to the thickness of paper to be passed between said rollers.

2. The control of claim 1 wherein said elastic means includes a coil spring.

3. The control of claim 1 further comprising an elongated rod with a first end rotatably supported and a second end distal from said first end attached to said elastic means, said fixing roller being attached to said rod at an intermediate point between said first and second ends.

4. The control of claim 1 wherein said adjusting means include solenoids operationally connected to said elastic means.

5. The control of claim 4 wherein said switching means are connected to said solenoids so as to selectively activate one of said solenoids.

* * * * *